US007220025B2

(12) United States Patent
Parker

(10) Patent No.: US 7,220,025 B2
(45) Date of Patent: May 22, 2007

(54) ILLUMINATION DEVICE HAVING OPTICAL PARTICLES FOR DIFFUSING LIGHT

(75) Inventor: Alan Frank Parker, Swindon (GB)

(73) Assignee: Beadlight Limited, New Yatt, Witney (GB)

( * ) Notice: Subject to any disclaimer, the term of this patent is extended or adjusted under 35 U.S.C. 154(b) by 0 days.

(21) Appl. No.: 10/651,072

(22) Filed: Aug. 28, 2003

(65) Prior Publication Data

US 2004/0042207 A1 Mar. 4, 2004

(30) Foreign Application Priority Data

Aug. 29, 2002 (GB) ..... 0220042.6

(51) Int. Cl.
*F21V 11/06* (2006.01)

(52) U.S. Cl. ..... 362/311; 362/267; 362/223; 362/240; 362/246

(58) Field of Classification Search ..... 362/555, 362/154, 240, 246, 311, 318, 3, 10, 551, 558, 362/582, 101, 102, 217, 223, 227, 244, 235–237, 362/257, 317, 326, 355, 339, 267; 359/615, 359/832, 227, 228, 661, 831
See application file for complete search history.

(56) References Cited

U.S. PATENT DOCUMENTS

| | | | | | |
|---|---|---|---|---|---|
| 2,383,941 | A * | 9/1945 | Otis | 362/256 |
| 3,067,352 | A * | 12/1962 | Vodicka et al. | 313/116 |
| 3,479,501 | A * | 11/1969 | Pisciotta et al. | 362/355 |
| 3,755,663 | A * | 8/1973 | George, Jr. | 362/249 |
| 3,995,151 | A * | 11/1976 | Nordeen et al. | 362/96 |
| 4,191,943 | A * | 3/1980 | Cairns et al. | 340/815.42 |
| 4,195,907 | A * | 4/1980 | Zamja et al. | 385/125 |
| 4,271,458 | A * | 6/1981 | George, Jr. | 362/236 |
| 4,376,966 | A * | 3/1983 | Tieszen | 362/249 |
| 4,466,697 | A * | 8/1984 | Daniel | 385/123 |
| 4,600,974 | A * | 7/1986 | Lew et al. | 362/102 |
| 4,929,021 | A * | 5/1990 | Kaye | 297/188.09 |
| 5,057,981 | A * | 10/1991 | Bowen et al. | 362/219 |
| 5,101,325 | A * | 3/1992 | Davenport et al. | 362/511 |
| 5,117,472 | A * | 5/1992 | Blyler et al. | 385/28 |
| 5,803,580 | A * | 9/1998 | Tseng | 362/318 |
| 5,934,792 | A * | 8/1999 | Camarota | 362/249 |
| 5,941,626 | A * | 8/1999 | Yamuro | 362/246 |
| 6,039,458 | A * | 3/2000 | Coates et al. | 362/249 |
| 6,336,735 | B1 * | 1/2002 | Eddins | 362/351 |
| 6,464,382 | B1 * | 10/2002 | Duflos | 362/520 |
| 6,601,971 | B1 * | 8/2003 | Ko | 362/219 |
| 6,672,552 | B1 * | 1/2004 | Jao | 362/102 |
| 2002/0080482 | A1 | 6/2002 | Watanabe et al. | |

FOREIGN PATENT DOCUMENTS

| | | |
|---|---|---|
| EP | 0 658 655 A1 | 12/1994 |
| FR | 2 771 888 A1 | 6/1999 |
| GB | 2 366 610 A | 3/2002 |
| GB | 2 372 136 A | 8/2002 |
| JP | 8-127297 A | 5/1996 |
| JP | 11-273427 A | 10/1999 |

* cited by examiner

*Primary Examiner*—Jong Suk Lee
*Assistant Examiner*—Ismael Negron
(74) *Attorney, Agent, or Firm*—Davis Bujold & Daniels, P.L.L.C.

(57) ABSTRACT

An illumination device comprising: a body member; one or more sources of light aligned on a longitudinal axis of, and lying within, the body member; one or more transparent regions of the body member through which light from the or each source passes when the source or sources are energized; and optical particles such as balls or chips of glass lying in the body member and extending between the or each source and that side of the or each transparent region which is directed towards the inside of the body member.

6 Claims, 1 Drawing Sheet

ILLUMINATION DEVICE HAVING OPTICAL PARTICLES FOR DIFFUSING LIGHT

FIELD OF THE INVENTION

This invention related to an illumination device. In particular it is concerned with an illumination device providing for more effective use of light from a light source.

BACKGROUND OF THE INVENTION

For a given power input light output from a light source can vary between that from a relatively small size source (say a light emitting diode) to that from a relatively large size source (say a resistive filament). A relatively high powered sources tend to generate light more efficiently than from a low powered one however high intensity light can dazzle a viewer who perhaps inadvertently views the element directly.

One way to overcome the matter of dazzle is to configure the illumination system so that direct viewing of the illuminated filament cannot occur. However this requirement is not always readily met typically in situations where the envelope available for the illumination system is limited in size.

Another way is to overcome dazzle is to provide an optical filter but this necessarily attenuates the light output so rendering superfluous the use of a relatively high powered source.

However the matter of dazzle is not usually a critical matter in connection with an illumination system. More significant is the degree to which the system can effectively and efficiently illuminate the objects, surface or area involved.

SUMMARY OF THE INVENTION

According to the present invention there is provided An illumination device comprising:

a body member;

one or more sources of light aligned on a longitudinal axis of, and lying within, the body member;

one or more transparent regions of the body member through which light from the or each source passes when the source or sources are energised; and optical particles such a balls or chips of glass lying in the body member and extending between the or each source and that side of the or each transparent region which is directed towards the inside of the body member. Typically the sources of light are a plurality of light emitting solid state devices and the optical particles are glass balls.

According to a first preferred version of the present invention the body member is a tube of glass forming the sole transparent region of the body member.

According to a second preferred version of the present invention or of the first preferred version thereof the optical particles are of uniform size and shape.

According to a third preferred version of the present invention or of the first preferred version thereof the optical particles vary in size over a spectrum of sizes. Typically the optical particles are of similar shape.

According to a fourth preferred version of the present invention or of any preceding preferred version thereof there are provided a plurality of sources of light and at least one of the sources differs in output colour from at least one other of the sources.

According to a fifth preferred version of the present invention or of any preceding preferred version thereof the interior of the body member not occupied by the sources or the optical particles is filed with a gas or vapour, which latter term includes air, maintained at a controlled pressure relative to ambient atmospheric pressure.

According to a sixth preferred version of the present invention or of any preceding preferred version thereof the body member is a sealed enclosure with conductors for electricity powering the or each light source passing through a wall of the enclosure by way of a gas tight seal.

BRIEF DESCRIPTION OF THE DRAWINGS

An exemplary embodiment of the invention will now be described with reference to the accompanying drawing of an illuminating device of which.

DETAILED DESCRIPTION OF THE INVENTION

Figure 1:
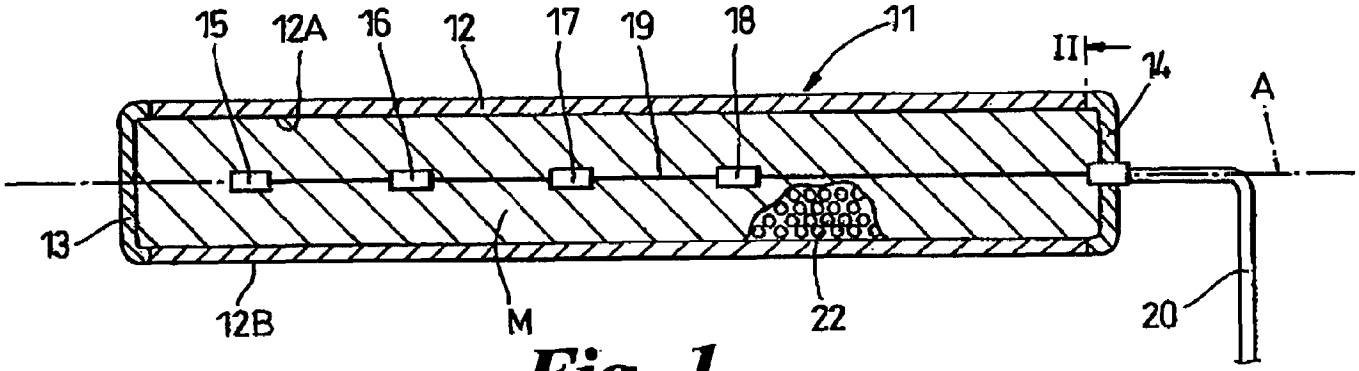
FIG. 1 is a sectional elevation.
Figure 2:
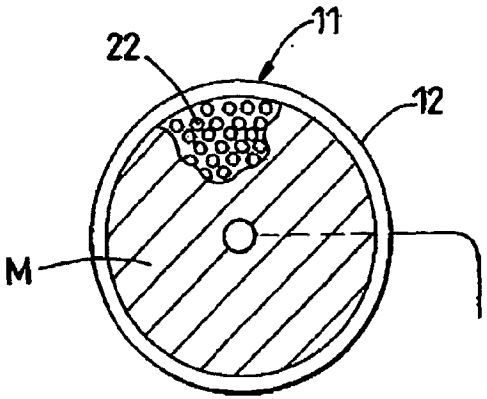
FIG. 2 is an end view of the device in direction of arrow II in FIG. 1.

The figures variously show an illumination device 11 comprising a body member 12 of glass with end closures 13, 14. Four high intensity light emitting diodes ('LED's') 15, 16, 17, 18 are linked by a lead 19 and aligned by a mounting frame of plastic material on axis A. The lead 19 extends through end closure 14 and is connected to an external lead 20 to provide power to energise LED's 15–18.

The body member 12 has an inner surface 12A and an outer surface 12B. The body member is filed with a mass M of optical particles 22, in this case glass balls, which extend from the LED's 15–18 to inner surface 12A of the body member 12.

The mass M provides a diffusion path for light from the LED's 15–18 so that with the LED's energised by way of leads 19, 20 light from each of LED's 15–18 passes through the mass M to inner surface 12A whence out of the body member 12. As a result the generated light from the LED's is not significantly attenuated. However rather than the LED's 15–18 appearing from outside the device 11 as four bright sources of light the light output from outer surface 12B of the device 11 is uniformly and homogeneously bright in appearance. Without the mass M, and so the diffusion effect it provides, a direct viewing by an observer of average eyesight the individually apparent energised LED's would be likely to cause dazzling. With the mass M in pace the resulting diffusing effect described results in the dazzling effect being substantially reduced if not eliminated. In addition apart from reducing the adverse effects of direct viewing the diffusion effect serves to improve illumination of an object by the device.

The body member 12 serves to house the LED's 15–18 and the mass M of optical particles 22. The overall size of the body member 12 is not large and is not limited as to shape. Consequently an illumination device according to the present invention can be made up in a configurations appropriate for use in one or more of a wide range of possible applications. In many applications space and/or access can be limited. The components making up the present device are inherently stable and the device is not subject to significant thermal cycling as arises from the use of device utilising one or more light sources based on resistive elements.

The optical particles 22 in the exemplary embodiment are glass balls. A wide range of glasses are available from which the balls can be selected according to design criteria for a given application. Other optical particles can be including ones of naturally occurring or man made material. Mixtures of such material could be used for particular applications where a particular optical effect is needed. For a given mass M the particles can either be of the same size or vary in size over a spectrum of sizes. The optical particles in a given mass can be uniform colour or vary in colour. In an experimental model the particles were optically pure spherical glass beads with a diameter lying in the range 1–2 mm. Tinted and/or non-optically pure beads could be used for particular applications.

In this case the body member 12 is an integral glass structure with inner surface 12A and external surface 12B. In an alternative version the body can be of relatively opaque material locating a transparent panel or transparent panels so that light from the LED's passes out through just the transparent panel or panels rather than from most if not all of the body member. The body member in this case is of glass. However plastics materials can be used. The body member is shown as being of cylindrical form. However the body member can be embodied in a wide range of sizes, shapes and structures including tubes, panels, multi-axis lights which can be straight and/or curved or combinations of shapes. If desired the body member can incorporate, or serve to retain, one or more lens elements so that light emitted from the body member by way of the, or each, lens element is changed in appearance from that emitted from the remainder of the body member.

Ranges of suitable LED's are available for use but ones of ultra high intensity have been found to be satisfactory for a number of experimental applications. Typically 'Plated Through Hole'('PTH') and Surface Mount (SMT) LED's have been used. There are range of colours available including white, blue, yellow/orange, red and green. A typical LED output power is 1 candela running at a driving voltage of 3.0–4.0 volts DC.

The number and spacing of the LED's within the body member can be selected without limitation since the body member can be designed to accommodate virtually any number, spacing or configuration.

The illumination device of the present invention is particularly intended as a device for illuminating objects in the vicinity of the device. Applications also exist in signaling or information display.

The invention claimed is:

1. An illumination device comprising:

a body member;

at least two sources of light aligned along a longitudinal axis of, and lying within, the body member;

at least one transparent region of the body member through which light from at least one source of light passes upon energization of the at least one source of light;

a plurality of closely packed but non-adhering transparent optical particles lying within the body member and extending contiguously between each source of light and a side of the at least one transparent region which is directed towards an inside of the body member;

wherein the body member is a sealed enclosure with conductors for electricity, for powering each source of light, passing through a wall of the enclosure by way of a gas tight seal.

2. The illumination device according to claim 1, wherein the body member is a tube of glass forming the sole transparent region of the body member.

3. The illumination device according to claim 1, wherein the optical particles are of uniform size and shape.

4. The illumination device according to claim 1, wherein the optical particles vary in size over a spectrum of sizes.

5. The illumination device according to claim 1, wherein the optical particles are of similar shape.

6. The illumination device according to claim 1, wherein an interior of the body member not occupied by the at least one source of light or the optical particles is filled with a gas or vapor, which latter term includes air, maintained at a controlled pressure relative to ambient atmospheric pressure.

* * * * *